US005211431A

United States Patent [19]

Koizumi et al.

[11] Patent Number: 5,211,431

[45] Date of Patent: May 18, 1993

[54] RECIPROCATING DEVICE FOR MOVABLE MEMBER

[75] Inventors: Kazuyoshi Koizumi; Masayuki Nishiyama, both of Yokohama, Japan

[73] Assignee: Nifco Inc., Kanagawa, Japan

[21] Appl. No.: 860,185

[22] Filed: Mar. 30, 1992

[30] Foreign Application Priority Data

Apr. 3, 1991 [JP] Japan ..... 3-21484[U]

[51] Int. Cl.[5] ..... E05B 47/00

[52] U.S. Cl. ..... 292/81; 292/DIG. 4; 74/574

[58] Field of Search ..... 292/81, DIG. 4, 336.3; 74/574, 573 F; 16/354, 82, 52, 62, 51

[56] References Cited

U.S. PATENT DOCUMENTS 4,688,695 8/1987 Hirohata ..... 292/DIG. 4 X
5,072,974 12/1991 Henne ..... 292/DIG. 4 X
5,121,521 6/1992 Hagiwara et al. ..... 16/354

FOREIGN PATENT DOCUMENTS 64-41434 2/1989 Japan .
4-64677 2/1992 Japan .

*Primary Examiner*—Richard E. Moore

*Attorney, Agent, or Firm*—Kanesaka and Takeuchi

[57] ABSTRACT

A reciprocating device for a movable member includes: a stationary member; a movable member held by the stationary member in such a manner as to be able to reciprocate; a biasing device provided between the movable member and the stationary member and adapted to bias the movable member in at least one of the reciprocating directions of the movable member; and a lock device for stopping the movable member in the course of its reciprocation, the lock device including: a cam groove formed on either the stationary member or the movable member and extending around a heart-shaped island; a lock pin having a base end section rotatably supported by either the stationary member or the movable member on which the cam groove is not formed and a tip end section bent toward the bottom of the cam groove; and a pressing device for pressing the tip end section of the lock pin toward the bottom of the cam groove, the pit section of the heart-shaped island of the lock device being equipped with a tapered surface inclined toward the bottom of a stop section of the cam groove, the tip end section of the lock pin being bent at an angle corresponding to the inclination of the tapered surface of the pit section of the heart-shaped island.

13 Claims, 11 Drawing Sheets

RECIPROCATING DEVICE FOR MOVABLE MEMBER

BACKGROUND OF THE INVENTION

The present invention relates to a reciprocating device for a movable member, such as a movable cover of household electrical appliances.

A known reciprocating device of this type comprises, for example, a stationary member, a movable member held by this stationary member in such a manner as to be reciprocated, biasing means provided between the movable member and the stationary member and adapted to bias the movable member in at least one of the reciprocating directions, and a lock device for stopping the movable member in the course of its reciprocation (see, for example, Japanese Patent Laid-Open No. 64-41434).

The above-mentioned lock device is equipped with a cam groove provided on either the stationary or the movable member and extending around a heart-shaped island, a lock pin whose base end section is rotatably supported by either the stationary or the movable member and whose tip end section is bent toward the bottom of the above-mentioned cam groove, and pressing means for pressing the tip end section of this lock pin toward the bottom of the cam groove.

The above cam groove is equipped with an introduction path extending toward a point tapered section of the heart-shaped island, a former path extending from this introduction path along one side of the heart-shaped island while gradually decreasing its depth, a turn-back section which is one step deeper than the shallowest end of the forward path and equipped with a dead end, a stop section which is adjacent to and still one step deeper than the turn-back section and which extends along the pit section of the heart-shaped island in the middle of the other end portion thereof, an escape section which is adjacent to and one step deeper than the stop section and which extends toward the other side of the heart-shaped island up to a dead end, and a return path which extends along the other side of the heart-shaped island while decreasing its depth to communicate with the above introduction path and whose shallowest end is one step higher than the bottom of the introduction path.

Further, the present applicant has already proposed a structure having a groove-like by-pass extending across the central portion of the heart-shaped island, from the stop section toward the introduction path thereof (see Japanese Patent Application No. 2-176941).

The end section facing the stop section of the by-pass is formed one step shallower than the bottom of the stop section, and a tapered surface is formed thereon which is inclined toward the bottom of the stop section of the cam groove. The tip end section of the lock pin is bent obliquely toward the bottom of the stop section of the cam groove.

A problem with the above-described conventional reciprocating device is that the movable member thereof is liable to break if it is forcibly moved in the lock-releasing direction when in a locked position.

The locked state of the lock device can be released by moving the movable member in the locking direction again. When the movable member is moved in that direction, the tip end section of the lock pin advances from the stop section to the escape section of the cam groove, thereby releasing the lock.

If, in contrast, the movable member is forcibly moved in the lock-releasing direction, the tip end section of the lock pin, which is in the stop section of the cam groove, abuts the pit section of the heart-shaped island, and prevents any further movement of the movable member.

However, in the case of household electrical appliances, a person, such as a child, who is not accustomed to use the apparatus, may attempt to forcibly move the movable member. Such a person may try to forcibly open the movable cover of the apparatus which has been locked by means of the reciprocating device.

In such a case, the pit section of the heart-shaped island of the cam groove may be scraped or broken off by the tip end section of the lock pin. Or, conversely, the tip end section of the lock pin may be bent or broken as a result of being pressed by the pit section of the heart-shaped island.

SUMMARY OF THE INVENTION

It is accordingly an object of the present invention to provide a movable-member reciprocating device in which breakage of the cam groove, the lock pin, etc. is prevented by making it possible for the lock of the device to be released if the movable member in the locked position is forced to move in the lock-releasing direction.

Another object of the present invention is to provide a movable-member reciprocating device which can be used as a counterpart of the movable-member reciprocating device so as to allow use of common parts for the stationary members of both reciprocating devices, and further, a movable-member reciprocating device which makes it possible to set the rotating angle of the movable member at a relatively large value.

In accordance with the present invention, a tapered surface inclined toward the bottom of the stop section of the cam groove is formed on the pit section of the heart-shaped island, and the tip end section of the lock pin is bent at substantially the inclination angle of the tapered surface of the pit section of the heart-shaped island.

According to the present invention, the stationary member is equipped with an arc-like rack formed around the axis of the movable member, and the stationary member is formed symmetrically with respect to an axis extending through the axis of the movable member. Attached to the movable member is a rotation damper having a gear which is in mesh with the rack of the stationary member.

With the movable-member reciprocating device of the present invention, any attempt to force the movable member to move in the lock-releasing direction of the lock device results in that the tip end section of the lock pin is brought into engagement with the tapered surface formed on the pit section of the heart-shaped island.

If a still larger force is applied to the movable member to force it to move, the tip end section of the lock pin is caused to jump up from the bottom of the stop section of the cam groove against the pressing force of the pressing means, due to the inclination of the tapered surface of the pit section of the heart-shaped island.

When the tip end section of the lock pin is thus caused to jump up from the bottom of the stop section of the cam groove, the lock of the lock device is released, thereby making it possible for the movable member to move freely in the lock releasing direction.

Further, in accordance with the present invention, the movable member is rotated on its axle in one of its rotating directions by the biasing force of biasing means. In this process, the gear of a rotation damper attached to the movable member rotates since it is engaged with the rack of the stationary member, with the result that the rotation damper exerts a damping force on the rack, thereby causing the movable member to rotate on its axle slowly and quietly.

DETAILED DESCRIPTION OF THE PREFERRED EMBODIMENTS

Figure 1:
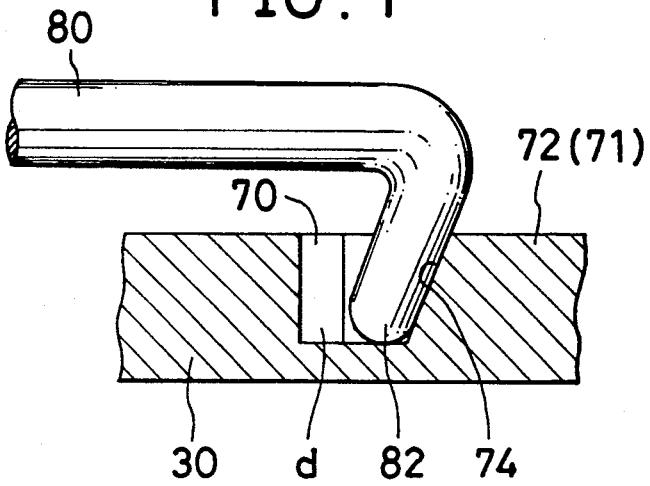
FIG. 1 is an enlarged view of an essential part of a reciprocating device according to the present invention, showing how the cam groove and the lock pin thereof are engaged with each other.

FIGS. 1 to 11 show the first embodiment of the present invention. In FIGS. 2 to 5, reference numeral 10 indicates a movable-member reciprocating device. The device 10 may be used, for example, in a movable cover which is rotatably supported by the front panel of a household electric apparatus, such as a television set or a video deck (not shown).

Arranged behind the movable cover are various operating switches (not shown). When the reciprocating device 10 is in the locked position, the movable cover is held substantially upright so as to be close and flush with the front panel, covering the operation switches behind it. When the front surface of the front panel is pushed inwardly, the lock of the reciprocating device 10 is released, and the movable cover falls outwardly down to open.

Figure 2:
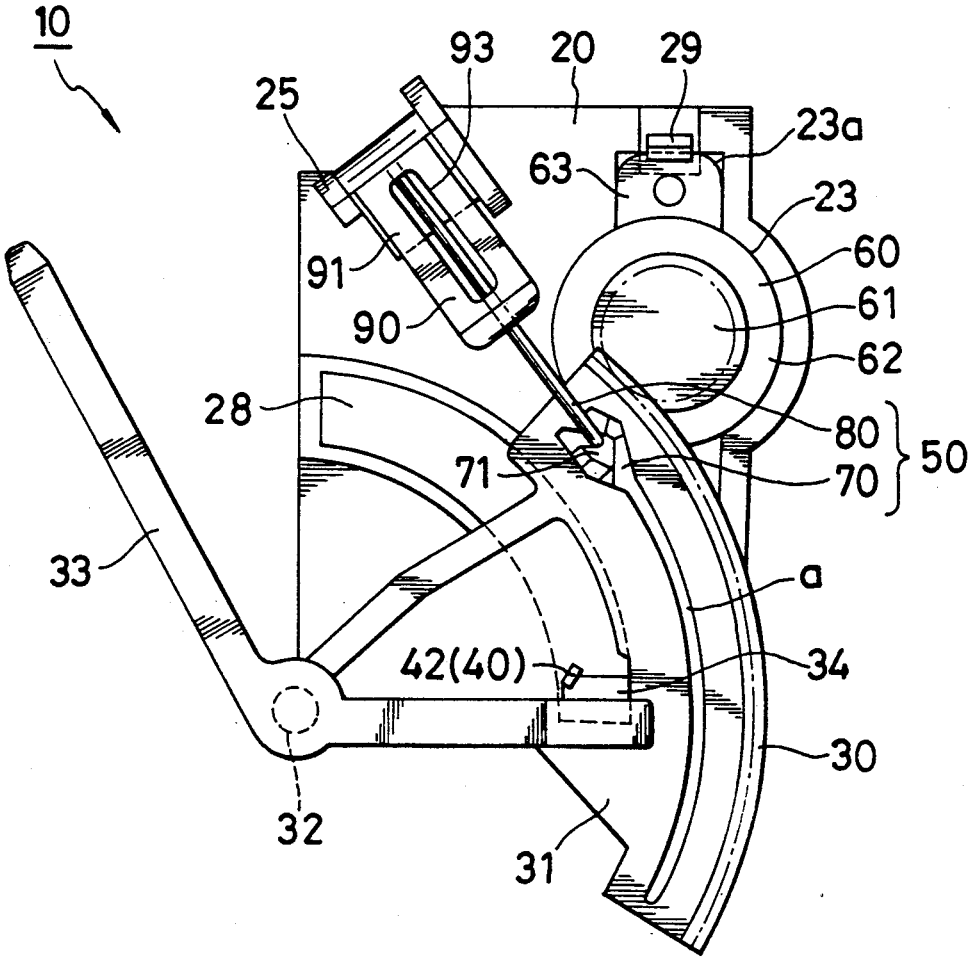
FIG. 2 is a front view of the reciprocating device.

As shown in FIGS. 2 to 5, the reciprocating device 10 comprises a base 20 serving as a stationary member, a rack 30 serving as a movable member and supported by the base 20 in such a manner as to be able to reciprocate, for example, as to be rotatable in the normal and reverse directions, a torsion spring 40 serving as biasing means for biasing the rack 30 counterclockwise as seen in FIG. 2, a locking device 50 for stopping the rack 30 in the course of rotation against the torsional return force of the torsion spring 40, and a rotation damper 60 serving as braking means which is fastened to the base 20 and equipped with a gear 61 in mesh with the rack 30.

As shown in FIGS. 1 and 2, the locking device 50 comprises a cam groove 70 formed on either the base 20 or the rack 30 (in this example, on the rack 30) so as to extend around a heart-shaped island 71, a lock pin 80 which has a base section 81 rotatably supported by the base 20 and a tip end section 82 bent toward the bottom of the cam groove 70, and a pressing spring 90 for pressing the tip end section 82 of the lock pin 80 toward the bottom of the cam groove 70.

First, the base 20 will be described. As shown in FIGS. 2 to 10, the base 20 comprises an axle hole 21 for rotatably supporting the rack 30, a boss section 22 protruding from the back surface of the base 20 and allowing a central ring section of the torsional spring 40 to pass therethrough, a fitting recess 23 which is indented with respect to the surface of the base 20 and into which the rotation damper 60 is fitted, and an attachment frame 25 allowing the attachment of the pressing spring 90 and having an axis receiving portion 24 which is slit-like shaped and rotatably supports a rock pin 80. The base 20 is formed of a synthetic resin having appropriate elasticity and rigidity, such as PS (polystyrene), as an integral unit.

As shown in FIGS. 2 to 5, the rack 30 comprises a sector-shaped rack body 31, a protruding axle 32 protruding from the back side at the center of this sector so as to be rotatably supported by the axle hole 21 of the base 20, and a connecting member 33 formed as a bar-like member positioned on the opposite side of the rack body 31 with respect to the protruding axle 32 and protruding obliquely upwards to be connected with the above-mentioned movable cover (not shown). The rack 30 is formed as one piece of a synthetic resin having high rigidity, such as POM (polyoxymethyelene).

Figure 3:
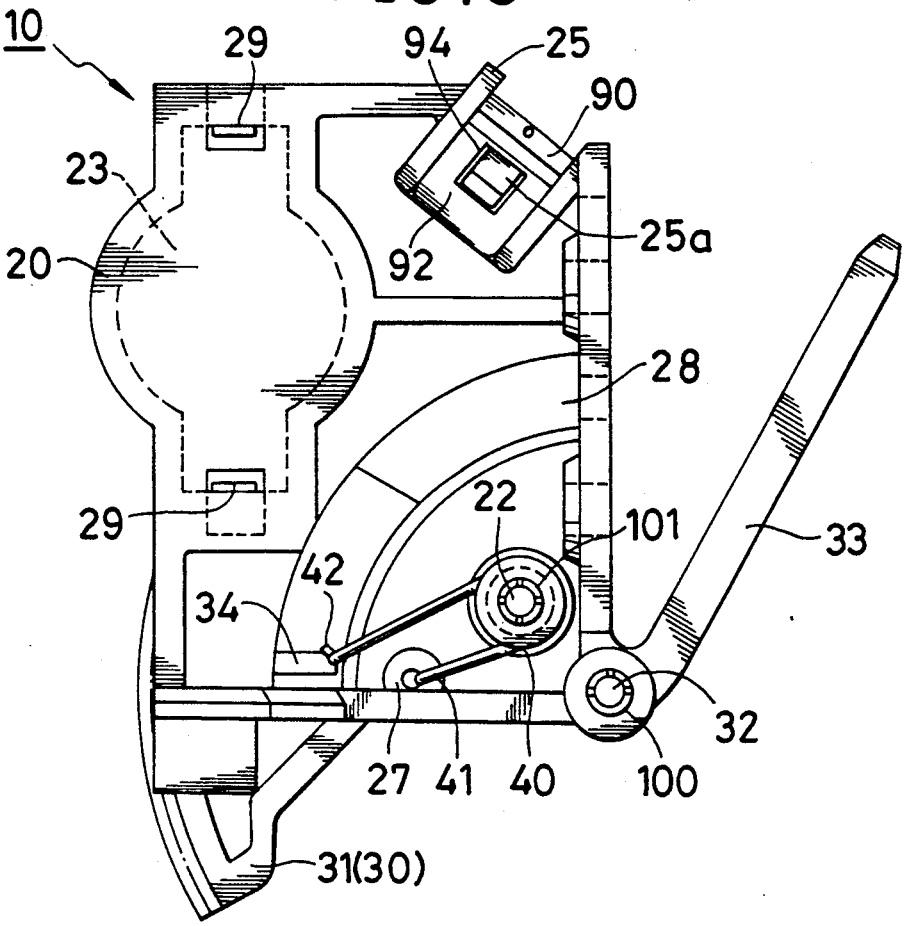
FIG. 3 is a rear view of the reciprocating device.
Figure 4:
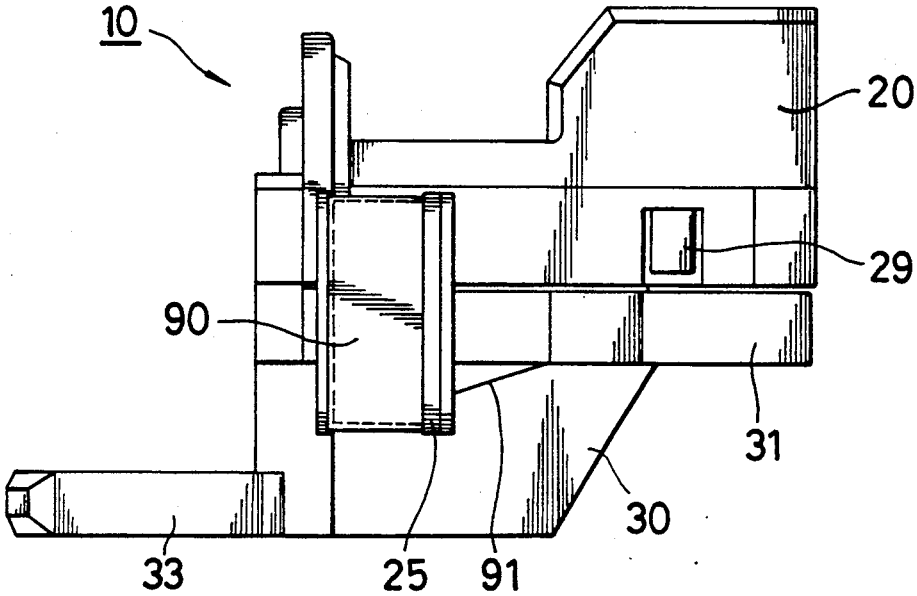
FIG. 4 is a plan view of the reciprocating device.

As shown in FIG. 3, the protruding axle 32 of the rack 30 passes through the axle hole 21 of the base 20 from the front to the back side and is secured by a bush-type nut 100 to prevent it from coming off.

As shown in FIG. 3, the torsion spring 40 has a coil-like configuration, and its central ring section passes through the boss section 22 on the back side of the rack 30. The torsion spring 40 is prevented from coming off by means of a bush-type nut 101 attached to the tip end portion of the boss section 22. Winding end portions 41 and 42 of the torsion spring 40 are bent toward each other, with one end portion 41 being hooked onto the base 20 and the other end portion 42 onto the rack 30.

First, as shown in FIG. 3, one winding end portion 41 of the torsion spring 40 is made to abut the inner surface of a side wall 26 protruding on the back side of the base 20 so as to extend along a side edge thereof.

Figure 9:
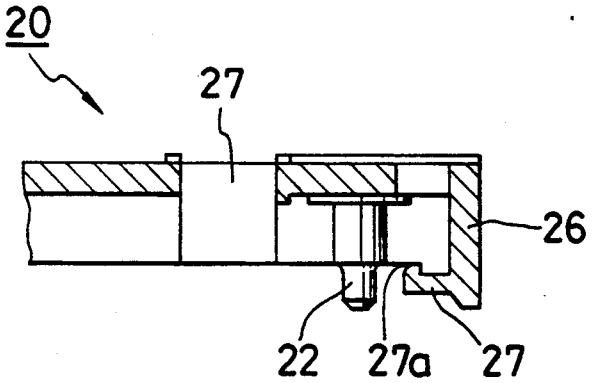
FIG. 9 is a sectional view taken along the line IX—IX of FIG. 7.

As shown in FIG. 9, formed on the side wall 26 is an L-shaped pressing member 27, by means of which one winding end portion 41 of the torsion spring 40 is prevented from being lifted up. Further, formed on the inner surface of the tip end portion of the pressing member 27 is a claw **27*a* having a sectional configuration protruding like a saw tooth. Thus, by pressing the one end portion 41 of the torsion spring 40 toward the back surface of the base 20 along the slope of the claw 27***a*, the end portion 41 can be easily fitted inside the pressing member 27.

Further, the other end portion 42 of the torsion spring 40 is bent into an L-shape, as shown in FIGS. 2 and 3.

As shown in FIGS. 2 and 3, formed on the base 20 is an arc-shaped cutout 28 which extends around the axle hole 21 and through which the other end portion 42 of the torsion spring 40 is passed. Formed on the rack 30 is an engagement hole 34 which extends from the front to the back surface of the rack and onto which the other winding end portion 42 of the torsion spring 40 is hooked.

As shown in FIGS. 2 and 3, one winding end portion 41 of the torsion spring 40 is led out to the front side through the arc-shaped cutout 28 of the base 20 and passes through the engagement hole 34 of the rack 30 so as to hook onto an edge of the hole on the front side.

Thus, by virtue of the restoring force of the torsion spring 40, which has the power to move the winding end portions 41 and 42 apart so as to undo the winding, a counterclockwise torque (as seen in FIG. 2) on the protruding axle 32 is imparted to the rack 30.

As shown in FIG. 2, the cam groove 70 is formed on the surface of the rack body 31 of the rack 30 so as to extend around the heart-shaped island 71.

Figure 11:
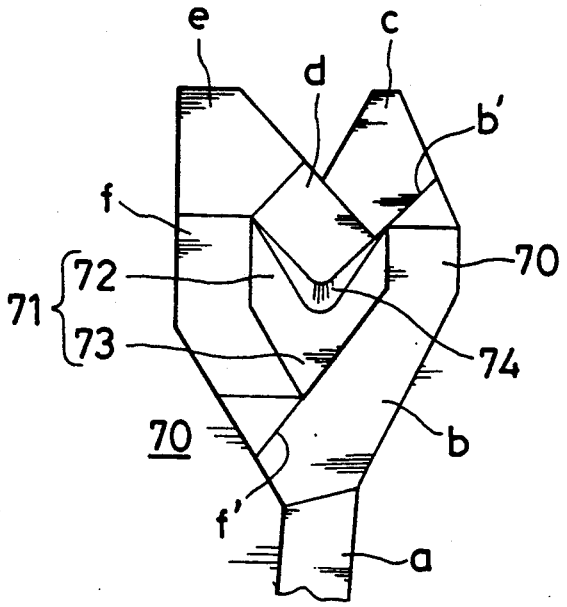
FIG. 11 is an enlarged view of the essential parts of the cam groove.

More specifically, the heart-shaped island 71 is positioned in front of the rack body 31 with respect to the direction of the rotation by the restoring force of the torsion spring 40. As shown in FIG. 11, the heart-shaped island 71 has a pit section 72 and a pointed tapered section 73 on the opposite side of the pit section 72. The pit section 72 of the heart-shaped island 71 is positioned forwardly, and the tapered section 73 rearwardly, with respect to the direction of rotation of the rack.

As shown in FIG. 11, the cam groove 70 comprises: an elongated arc-like introduction path (a) extending toward the pointed tapered section 73 of the heart-shaped island 71 and having a dead-end rear portion; a forward path (b) extending forwards along one side of the heart-shaped island 71 while becoming gradually shallower as compared to the introduction path (a); a dead-end turn-back section (c) which is one step deeper than the shallowest end (b') of the forward path (b); a stop section (d) which is adjacent to and still one step deeper than the turn-back section (c) and which extends along the pit section 72 of the heart-shaped island 71; an escape section (e) which is adjacent to and still one step deeper than the stop section (d) and which extends toward the other side of the heart-shaped island 71 to reach a dead end; and a return path (f) which extends along the other side of the heart-shaped island 71 while becoming gradually shallower than the escape section (e) so as to communicate with the introduction path (a) and whose shallowest end (f') is one step higher than the bottom of the introduction path (a).

Further, as shown in FIGS. 1 and 11, formed on the pit section 72 of the heart-shaped island 71 is a tapered surface 74 inclined toward the bottom of the stop section (d) of the cam groove 70. As shown in FIG. 11, the tapered surface 74 has a crescent configuration as seen in plan view. Further, as shown in FIG. 1, the tapered surface 74 has a steep slope of approximately 70° with respect to the bottom of the stop section (d).

Figure 5:
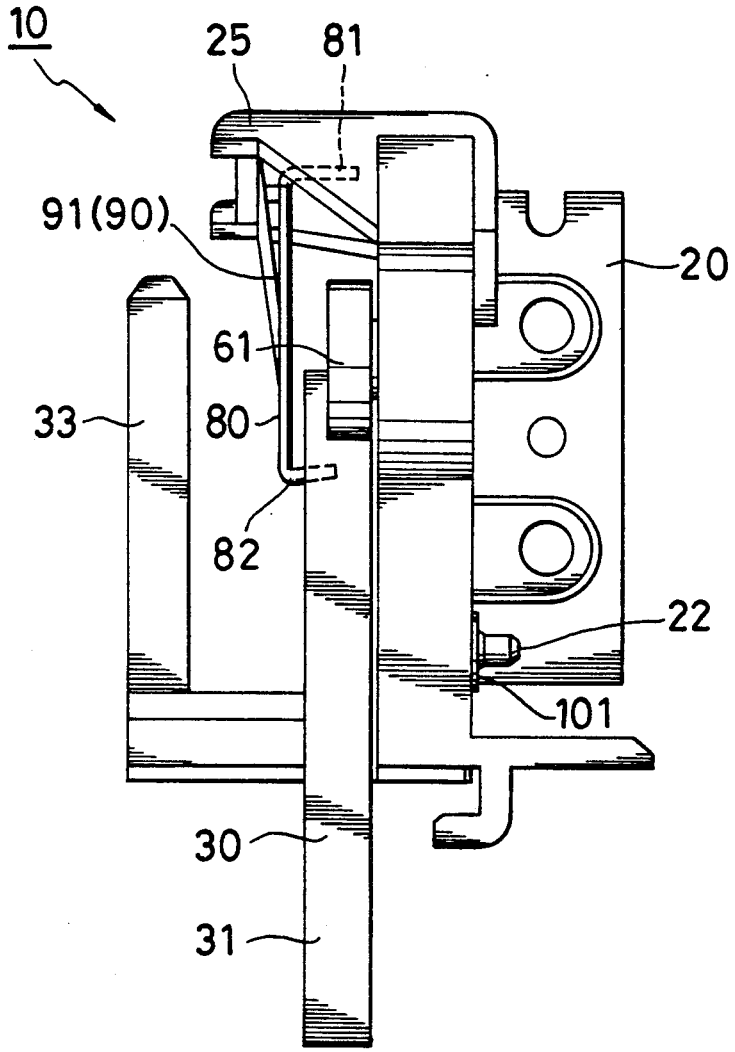
FIG. 5 is a side view of the reciprocating device.

As shown in FIGS. 1, 2 and 5, the lock pin 80 is formed of a wire rod, such as a piano wire, and its end portions are bent in the same direction in a substantially U-shape. The base end section 81 of the lock pin 80 is longer than the other end section 82 thereof, and is bent at right angles in a substantially L-shape. As shown in FIG. 1, the tip end section 82 of the lock pin 80 is bent in a substantially V-shape at approximately the same angle as the inclination of the tapered surface 74 of the pit section 72 of the heart-shaped island 71.

As shown in FIGS. 1, 2 and 5, the base end section 81 of the lock pin 80 is fitted into a slit-like bearing section 24 in the attachment frame 25 of the base 20, and the other end section 82 thereof is inserted into the cam groove 70 of the rack 30.

As shown in FIGS. 2 to 5, end portions 91 and 92 of the pressing spring 90 are bent in a substantially U-shape toward the front and back surfaces of the attachment frame 25 of the base 20. One end portion 91 of the pressing spring 90, which is bent on the front side of the attachment frame, is longer than the other end portion 92 thereof, which is bent on the back side of the same. Further, rectangular punched-out holes 93 and 94 are formed in the end portions 91 and 92, respectively, of the pressing spring 90, which is bent on the front and rear sides of the frame 25.

Figure 7:
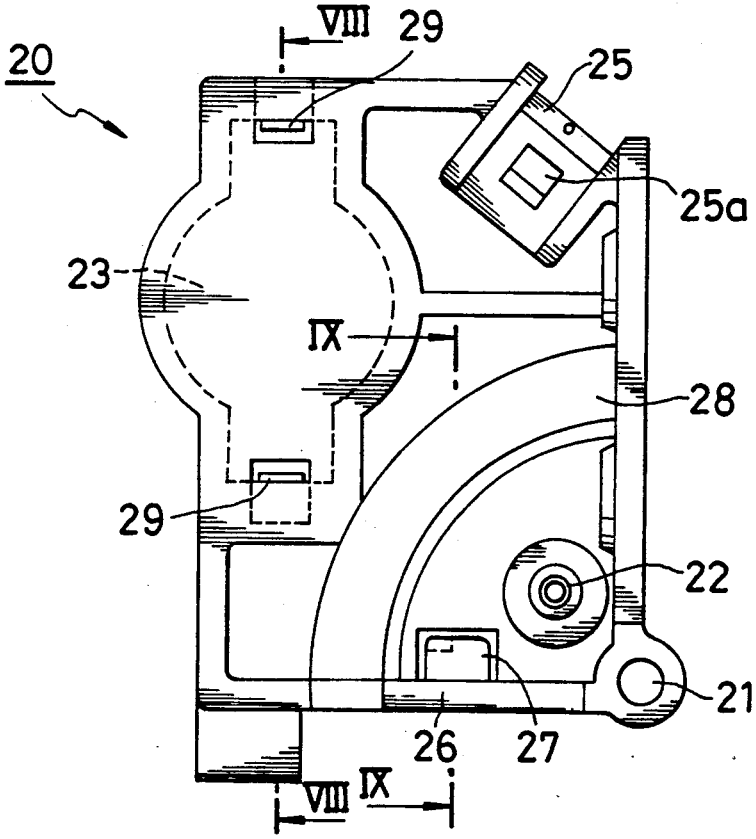
FIG. 7 is a rear view of the base.
Figure 10:
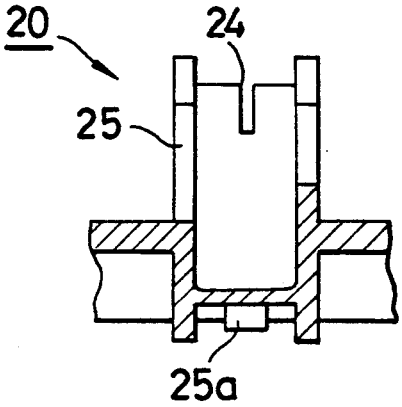
FIG. 10 is a sectional view taken along the line X—X of FIG. 6.

As shown in FIGS. 7 and 10, formed on the attachment frame 25 of the base 20 is a claw 25*a* protruding like a saw tooth and adapted to fit into the punched-out hole 94 of the other end portion 92 of the pressing spring 90.

As shown in FIGS. 2 to 5, the end portions 91 and 92 of the pressing spring 90 are fitted sideways onto the front and back surfaces of the attachment frame 25 of the base 20. As shown in FIG. 3, when the pressing spring 90 is fitted onto the attachment frame 25, the claw 25*a* of the attachment frame 25 fits into the punched-out hole 94 of the other end portion 92 of the spring 90 bent on the back side of the attachment frame 25, thereby preventing the spring 90 from being detached from the attachment frame 25.

When the pressing spring 90 has been mounted in this way, one end portion 91 thereof, which is bent on the front side of the frame, blocks the open end of the slit-like bearing section 24 of the attachment frame 25, thereby preventing the lock pin 80 from being detached from the bearing section 24. The lock pin 80 is pressed toward the bottom of the cam groove 70 of the rack 30 by the spring force of one end portion 91 of the pressing spring 90.

The above-mentioned rotation damper 60 consists, for example, of an oil damper. That is, a housing 62 of the rotation damper 60 may be filled with silicon oil or the like, which has high viscous resistance. By virtue of the high viscous resistance of the oil, a braking force is exerted on the torque of an input shaft of the rotation damper extending through the housing 62 thereof. As shown in FIGS. 2 and 5, fastened to a protruding end portion of the input shaft of the rotation damper is a gear 61, which is in mesh with the rack 30. Further, formed on the housing 62 are a pair of attachment members 63 and 64 protruding in opposite directions.

Formed on the fitting recess 23 of the base 20 are a pair of indentations 23*a*, into which the above-mentioned attachment members 63 and 64 of the rotation damper 60 are fitted.

Figure 6:
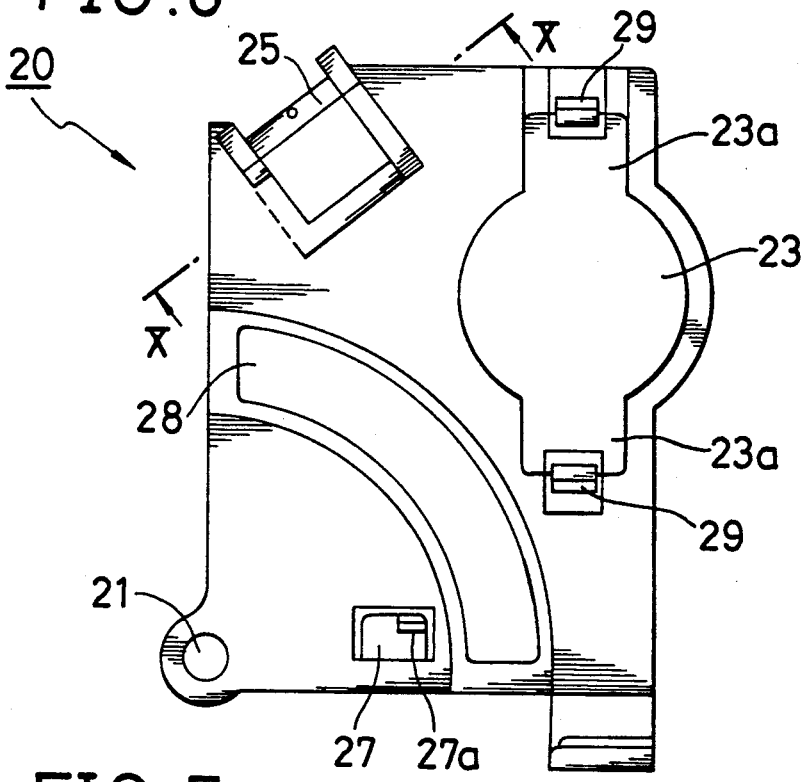
FIG. 6 is a front view of the base of the device.
Figure 8:
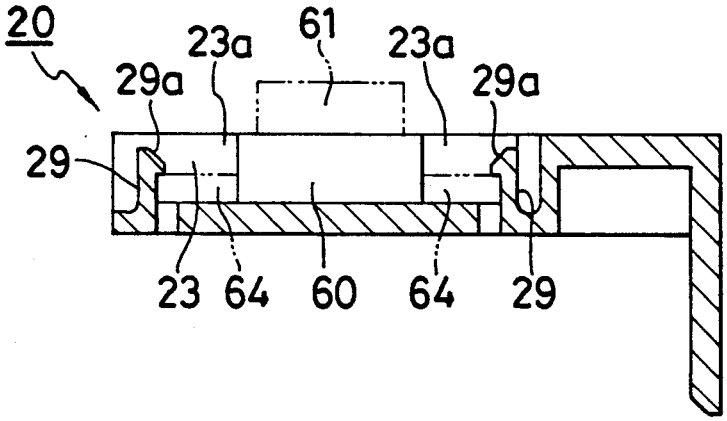
FIG. 8 is a sectional view taken along the line VIII—VIII of FIG. 7.

As shown in FIGS. 6 and 8, formed in the above-mentioned indentations 23*a* are a pair of elastic engagement members 29 extending upwardly from the bottoms of the indentations 23*a* and spaced apart from each other by a distance corresponding to the space between the attachment members 63 and 64 of the rotation damper 60. Formed at the tip ends of the elastic engagement members 29 are opposed claws 28*a* and 29*a* protruding like saw teeth and adapted to hook onto the upper edges of the attachment members 63 and 64 of the housing 62.

As shown in FIGS. 2 and 8, the rotation damper 60 can be mounted by fitting the attachment members 63 and 64 of its housing 62 into the indentations 23*a* of the fitting recess 23 of the base 20.

That is, when the attachment members 63 and 64 of the housing 62 are fitted in the recess 23, these attachment members engage the claws 28*a* of the elastic engagement members 29. When the housing 62 is further forced into the fitting recess 23, the attachment members 63 and 64 press the claws 28*a*, thereby causing the elastic engagement members 29 to be bent in opposite directions. As a result, the distance between tip ends of the elastic engagement members 29 increases, thus allowing the attachment members 63 and 64 of the housing 62 to be fitted into the space between these elastic engagement members. When the attachment members 63 and 64 have been thus secured in position, the elastic engagement members 29 are snapped back into the former state due to the elastic restoring force of the resin of which they are made, thereby preventing the housing 62 from being detached from the fitting recess 23 of the base 20.

Next, the operation of the reciprocating device 10, constructed as described above, will be explained.

First, suppose the reciprocating device 10 is in the locked position. To release this lock, the connecting member 33 of the rack 30 is rotated a little clockwise as seen in FIG. 2.

When the rack 30 rotates, the position of the cam groove 70 formed on the surface thereof changes. As a result, the tip end section 82 of the lock pin 80, which has been in the stop section (d) of the cam groove 70, advances as the cam groove 70 changes its position, and reaches the escape section (e), which is one step deeper than the stop section (d). Since the turn-back section (c) is one step shallower than the stop section (d), the tip end section 82 of the lock pin 80 cannot move from the stop section (d) to the turn-back section (c).

Thus, the tip end section 82 of the lock pin 80 advances to the escape section (e). Since the other end of the escape section (e) is formed as a dead end, the tip end section 82 of the lock pin 80 abuts this end, so that the rack 30 cannot be rotated any more.

When, in this connection, the operator releases the rack 30, it rotates counterclockwise (as seen in FIG. 2) by virtue of the restoring force of the torsion spring 40.

The rotation of the rack 30 causes the position of the cam groove 70 to change. As a result, the tip end section 82 of the lock pin 80, which has been in contact with the end portion of the escape section (e) of the cam groove 70, moves backwards through the escape section (e) and advances from the escape section (e) to the return path (f). Since the stop section (d) is one step shallower than the escape section (e), the tip end section 82 of the lock pin 80, which has advanced to the escape section (e), cannot move back to the stop section (d) therefrom.

The tip end section 82 of the lock pin 80, which has thus advanced to the return path (f), moves, as the rack 30 further rotates, to the introduction path (a), which is one step deeper than the return path (f).

As the rack 30 rotates, the gear 61, which is in mesh with the teeth of the rack 30, rotates and causes the input shaft of the rotation damper 60 to rotate integrally therewith, with the result that the braking force of the rotation damper 60 is exerted on the rack 30. By virtue of this braking force, the rack 30 rotates slowly and quietly.

The maximum opening position of the rack 30 is restricted by the tip end section 82 of the lock pin 80 when it abuts the dead end of the introduction path (a).

The reciprocating device 10 can be locked again by rotating the connecting member 33 of the rack 30 counterclockwise as seen in FIG. 2.

The rotation of the rack 30 causes the tip end section 82 of the lock pin 80, which has been in the introduction path (a) of the cam groove 70, to move backwards in the path to advance therefrom to the forward path (b). Since the shallowest end (f') of the return path (f) is one step shallower than the introduction path (a), the tip end section 82 of the lock pin 80, which has advanced to the introduction path (a), cannot return therefrom to the return path (f).

When the rack 30 is further rotated, the tip end section 82 of the lock pin 80, which has advanced to the forward path (b), moves to the turn-back section (c), which is one step deeper than the forward path (b). Since the other end of the turn-back section (c) is formed as a dead end, the tip end section 82 of the lock pin 80, which has moved to the section (c), abuts this end, thereby making a further rotation of the rack 30 impossible.

Accordingly, when the operator releases the rack 30, it rotates in the reverse direction due to the restoring force of the torsion spring 40.

As a result of the reverse rotation of the rack 30, the tip end section 82 of the lock pin 80 moves backwards in the turn-back section (c) and advances to the stop section (d), which is one step deeper than the turn-back section (c). Since the shallowest end (b') of the forward path (b) is one step shallower than the turn-back section (c), the tip end section 82 of the lock pin 80, which has moved backwards through the turn-back section (c), cannot return therefrom to the forward path (b).

When it has advanced to the stop section (d), the tip end section 80 of the lock pin 82 is caught by the pit section 72 of the heart-shaped island 71 and receives the restoring force of the torsion spring 40, thereby locking the reciprocating device 10 again.

Next, described will be a case where the connecting member 33 of the rack 30 is forced to rotate counterclockwise as seen in FIG. 2 when the reciprocating device 10 is in the locked state.

If a force is applied to the rack 30 to force it to rotate counterclockwise when it is in the locked position, the tip end section 82 of the lock pin 80, which is in the stop section (d) of the cam groove 70, abuts the tapered surface 74 of the pit section 72 of the heart-shaped island 70 and resists this force.

If, in this condition, a still larger force is applied to forcibly rotate the rack 30, the tip end section 82 of the lock pin 80 is pushed upwards along the tapered surface 74 since the bending angle of the tip end section 82 of the lock pin 80 substantially coincides with the inclination of the tapered surface 74 of the heart-shaped island 71. As a result, the tip end section 82 of the lock pin 80 is caused to jump up from the bottom of the stop section (d) of the cam groove 70 against the restoring force of the pressing spring 90.

When the tip end section 82 of the lock pin 80 goes over the upper edge of the tapered surface 74 of the heart-shaped island 71, the lock of the reciprocating device 10 is released, and the rack 30 rotates counterclockwise as seen in FIG. 2 by the restoring force of the torsion spring 40.

At this time, the tip end section 82 of the lock pin 80 is being depressed toward the bottom of the cam groove 70 by the restoring force of the pressing spring 90. Thus, after it has gone over the heart-shaped island 71 as a result of the rotation of the rack 30, the tip end section 82 of the lock pin 80 falls onto the bottom of the forward path (b) of the cam groove 70. The tip end section 82 of the lock pin 80, which has thus fallen onto the forward path (b) of the cam groove 70, is caused to advance therefrom to the introduction path (a) as the rack 30 further rotates. When it abuts the dead end of the introduction path (a), the tip end section 82 of the lock pin 80 receives the restoring force of the torsion spring 40, and the rotation of the rack 30 is stopped.

While this embodiment has been described as applied to a movable cover of household electrical appliances, such as a television set or a video deck, this should not be construed restrictively. The embodiment is also applicable to the cover of a piece of furniture or an office apparatus, or to the cover of a console arranged in the interior of a vehicle or the like. Further, apart from covers, the embodiment is also applicable to a slide ashtray for a vehicle interior or the like. That is, instead of rotatably supporting the rack 30, which serves as the movable member, on the base 20, which serves as the stationary member, it is also possible to slidably support the movable member on the stationary member.

The biasing means is not restricted to the torsion spring 40. Instead, it is also possible to employ a spiral spring or the like.

Further, although in the above embodiment the pressing spring 90 is used as the pressing means, the type of spring used is not restricted to a metal plate spring. It is also possible to press the tip end section 82 of the lock pin 80 toward the bottom of the cam groove 70 by utilizing the compression restoring force of a coil spring or the like.

FIGS. 12 to 23 show another preferred embodiment of the present invention.

This embodiment constitutes a counterpart of the above-described first embodiment, and differs therefrom in that it has no lock device 50, that the rack is formed on the stationary member, and that the rotation damper having a gear which is in mesh with the rack is fastened to the movable member, thereby making it possible to use common parts for the stationary members of these embodiments.

Figure 12:
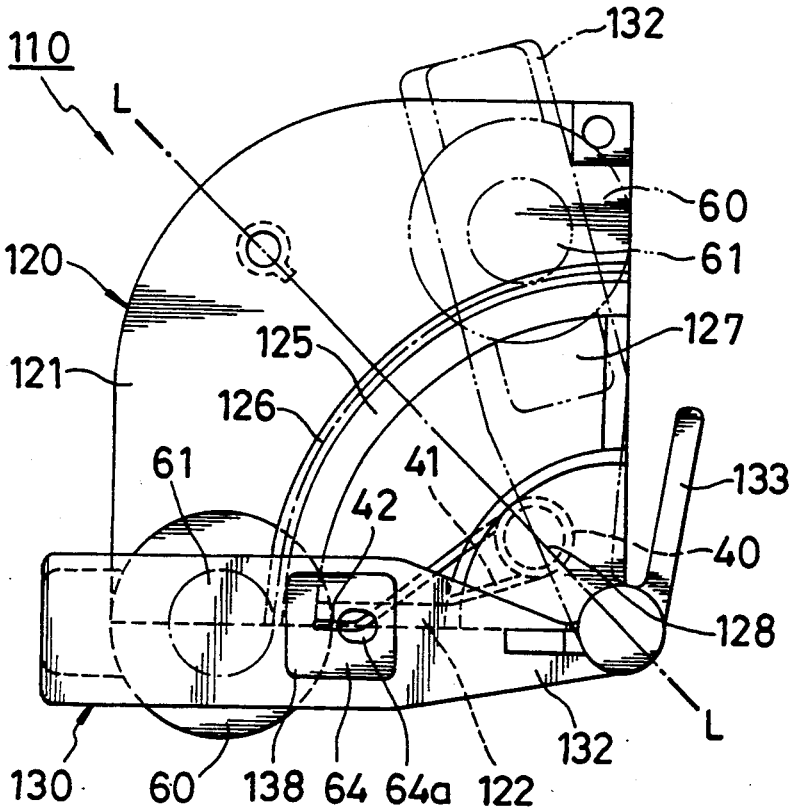
FIG. 12 is a front view of a reciprocating device according to another embodiment of the present invention.
Figure 13:
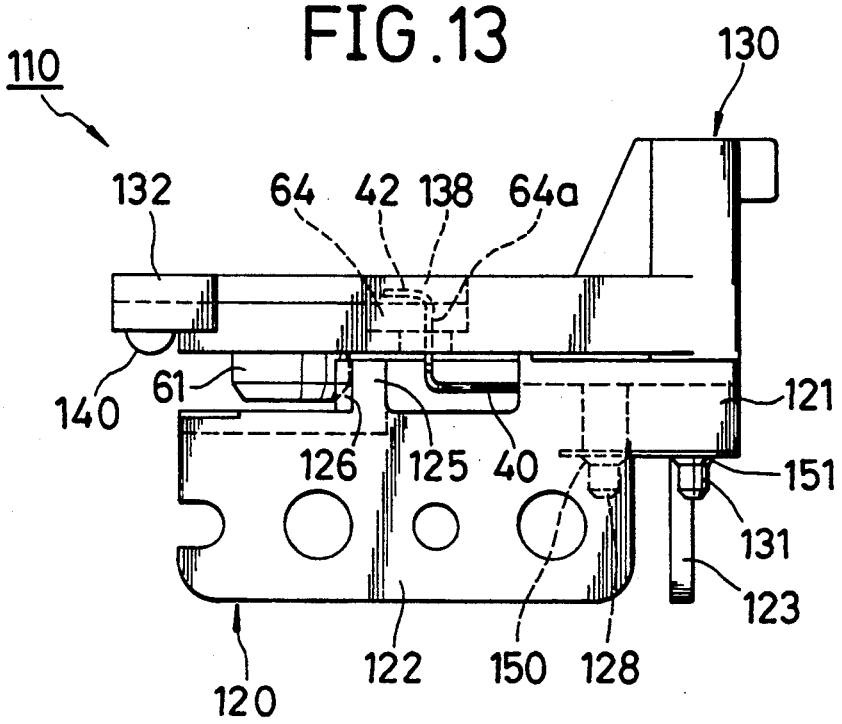
FIG. 13 is a bottom view of the reciprocating device.
Figure 14:
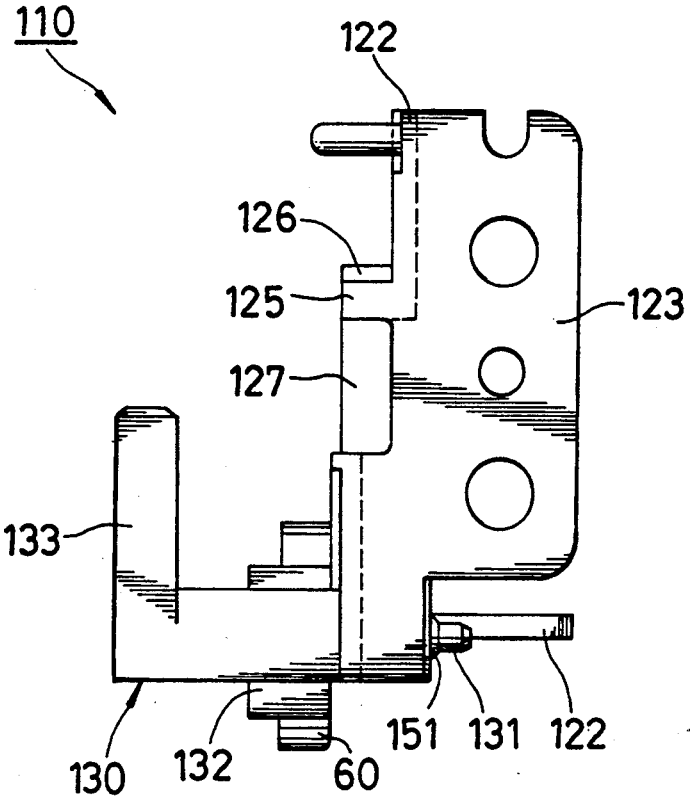
FIG. 14 is a side view of the reciprocating device.

As shown in FIGS. 12 to 14, a reciprocating device 110 according to this embodiment comprises a base 120 serving as the stationary member, an arm 130 supported by the base 120 in such a manner as to be rotatable on a protruding axle 131 and serving as the movable member which is rotatable in the normal and reverse directions, a torsion spring 40 provided between the arm 130 and the base 120 and serving as the biasing means for biasing the arm 130 clockwise as seen in FIG. 12, and a rotation damper 60 for damping the torsional resilient returning force of the torsion spring 40.

As shown in FIGS. 15 to 18, the base 120 comprises a substantially ¼-sector-shaped base body 121 and a pair of attachment members 122 and 123 protruding backwardly from linear lower and side edges of the base body 121. The base 120 is formed of a synthetic resin, such as ABS, as one integral unit.

As shown in FIGS. 15 to 18, the base body 121 comprises an axle hole 124 rotatably supporting the protruding axle 131 of the arm 130 and formed at a point substantially corresponding to the center of the sector, an arc-like rib 125 formed as a substantially ¼-arc-shaped section around the axle hole 124 and protruding from the surface of the base body 121, a rack 126 formed on the outer peripheral surface of the arc-like rib 125 and in mesh with a gear 61 of the rotation damper 60, an arc-like cutout 127 formed along the inner peripheral surface of the arc-like rib 125, and a boss section 128 which is positioned between the arc-like cutout 127 and the axle hole 124 and on a symmetry line L—L dividing the base body 121 in two and intersecting the axle hole 124 and through which a central ring section of the torsion spring 40 passes.

Figure 15:
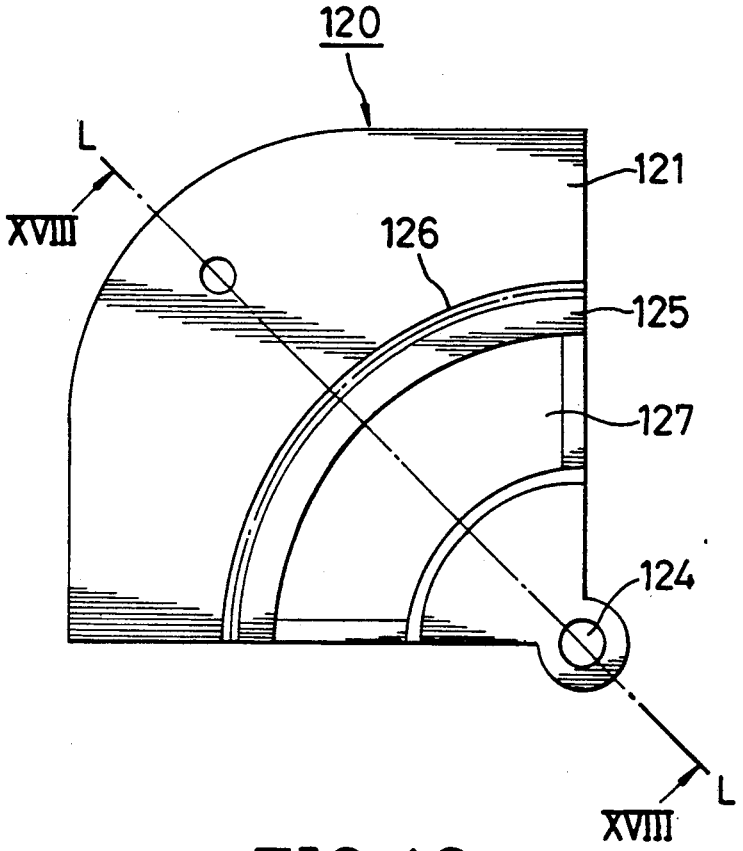
FIG. 15 is a front view of the base of the device.
Figure 16:
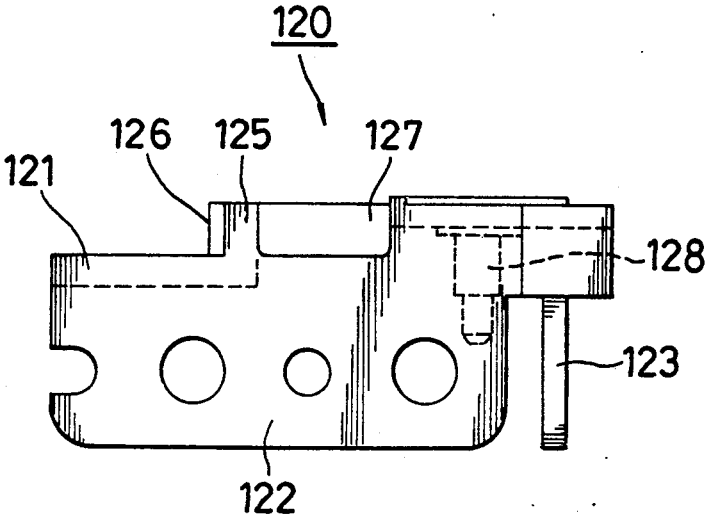
FIG. 16 is a bottom view of the base.
Figure 17:
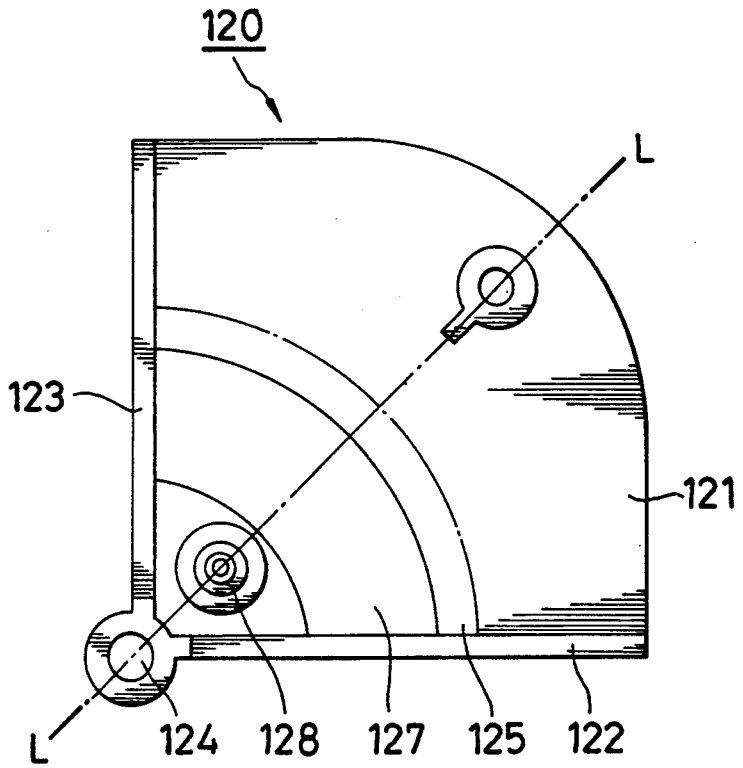
FIG. 17 is a rear view of the base.
Figure 18:
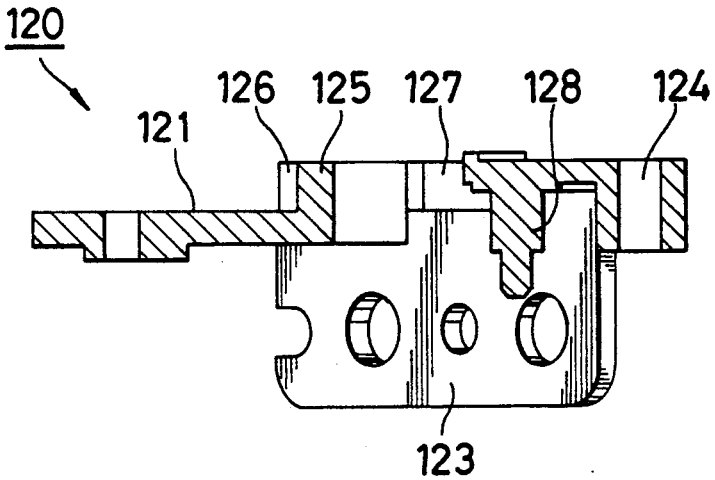
FIG. 18 is a sectional view taken along the line XVIII—XVIII of FIG. 15.

As shown in FIGS. 15, 16 and 18, the attachment members 122 and 123 are formed symmetrically with respect to the symmetry line L—L intersecting the axle hole 124 of the base body 121.

As shown in FIGS. 19 to 23, the arm 130 comprises an arm body 132 having the above-mentioned protruding axle 121 at one end, and a bar-like connecting member 133 positioned on the opposite side of the arm body 132 with respect to the protruding axle 131 and extending obliquely upwards to be connected with a movable cover (not shown). The arm 130 is formed of a synthetic resin, such as POM, as one integral unit.

As shown in FIGS. 20 to 23, the protruding axle 131 protrudes from the back side of the arm body 132.

As shown in FIGS. 20 to 23, formed on the arm body 132 is a fitting recess 134 which is indented from the back surface thereof and into which the rotation damper 60 is fitted.

Figure 21:
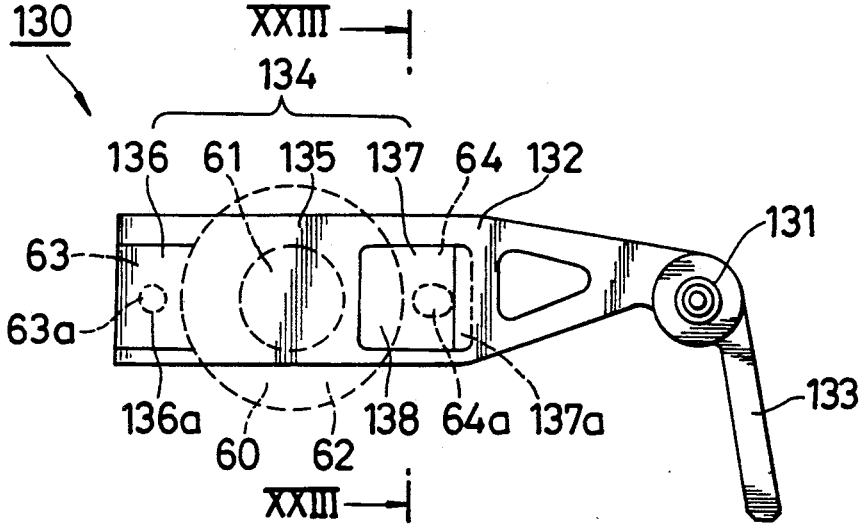
FIG. 21 is a rear view of the arm.
Figure 22:
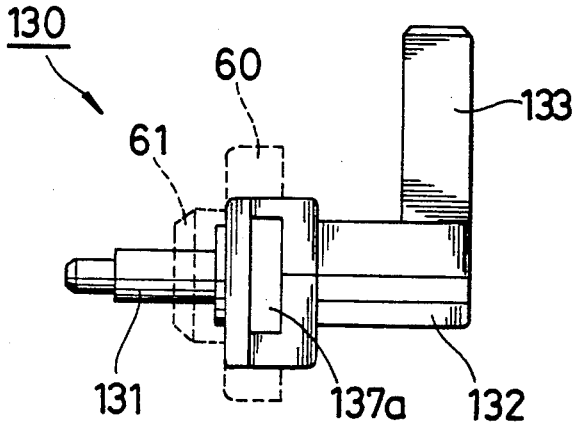
FIG. 22 is a right-hand side view of the arm.
Figure 23:
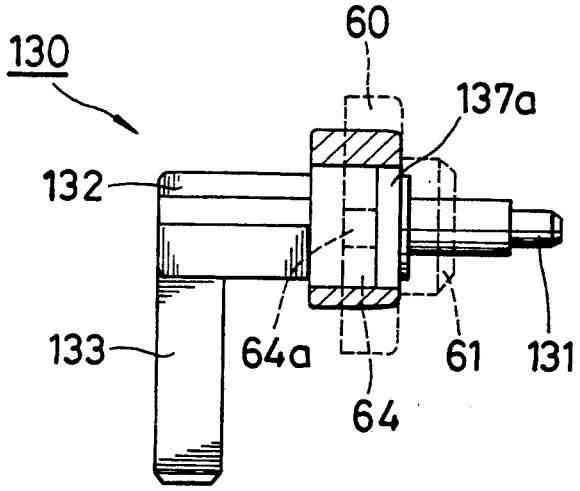
FIG. 23 is a sectional view taken along the line XXIII—XXIII of FIG. 21.

As shown in FIG. 21, the fitting recess 134 comprises a central indentation 135 into which a round housing 62 of the rotation damper 60 is fitted and a pair of side indentations 136 and 137 which are connected to the right and left sides of the central indentation 135 and into which are fitted a pair of attachment members 63 and 64 protruding in opposite directions from the housing 62.

As shown in FIGS. 19 to 21 and 23, a window 138 communicating the front side of the arm body 132 with the back side thereof is provided astride the central indentation 135 and the indentation 137 on the side of the protruding axle 131 of the arm body 132. The window 138 faces a substantially elliptical attachment hole **64*a* formed in one attachment member 64 of the rotation damper 60**.

Further, as shown in FIGS. 19 to 23, formed at an end of the indentation 137 of the arm body 132 on the side of the protruding axle 131 is an insertion section **137*b* into which one attachment member 64 of the rotation damper 60** is inserted.

Figure 19:
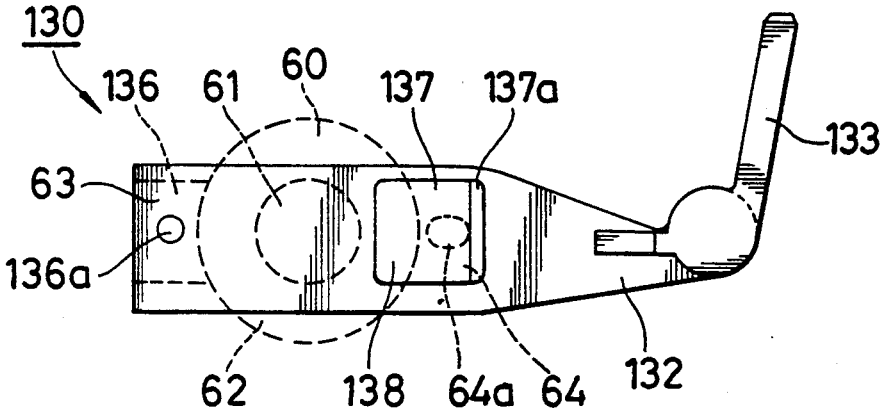
FIG. 19 is front view of an arm of the device.
Figure 20:
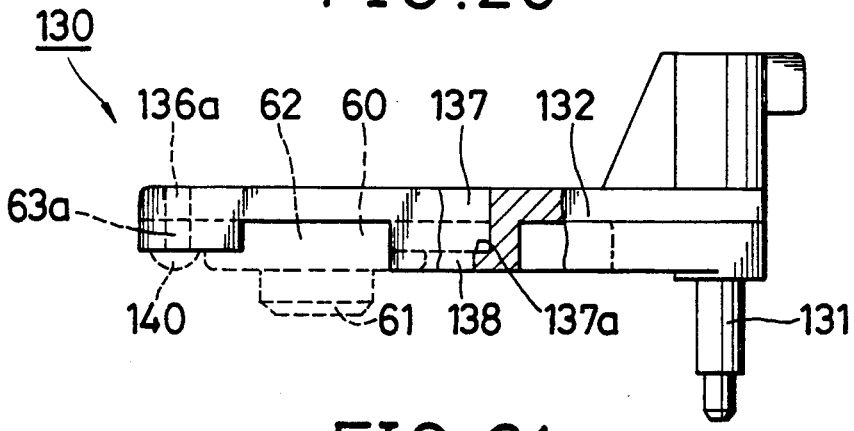
FIG. 20 is a partially cutaway bottom view of the arm.

As shown in FIGS. 19 to 21, formed substantially at the center of the indentation 136 on the side of the free end of the arm body 132 is a circular small hole **136*a*, which communicates with a circular attachment hole 63*a* formed in the other attachment member 63 of the rotation damper 60**.

Thus, as shown in FIGS. 13 and 20, the rotation damper 60 is fitted into the fitting recess 134 of the arm 130 while inserting one attachment member 64 thereof into the insertion section **137*a*. After that, a bolt 140 is screwed into the attachment hole 63*a* of the other attachment member 63 of the rotation damper 60 and the small hole 136*a* of the arm 130, thereby securing the housing 62 of the rotation damper 60 in the fitting recess 134 of the arm 130**.

Next, as shown in FIGS. 12 to 14, the arm 130 is attached to the base 120. When attaching the arm to the base, the gear 61 of the rotation damper 60, which has been fixed to the arm 130, is made to engage the rack 126 of the base 120. Further, as shown in FIGS. 12 and 13, when attaching the arm 130 to the base, the central ring section of the torsion spring 40 is passed through the boss section 128 protruding from the back side of the base 120, and a bush-type nut 150 is attached to the tip end portion of the boss section 128, thereby preventing the torsion spring 40 from coming off.

As shown in FIGS. 12 and 13, the protruding axle 131 of the arm 130 is passed through the axle hole 124 of the base 120 from the front to the back side thereof and a bush-type nut 151 is attached to the protruding axle 131 from the back side, thereby preventing the arm 130 from being detached from the base 120.

Afterwards, as shown in FIG. 12, one winding end portion 41 of the torsion spring 40, which has been passed through the boss section 128 of the base 120, is caused to abut the inner side surface of one attachment member 122 extending along the lower edge of the base 120.

As shown in FIG. 13, the other winding end portion 42 of the torsion spring 40 is bent into a crank-like configuration. As shown in FIGS. 12 and 13, the other winding end portion 42 of the torsion spring 40 is led through the arc-like cutout 127 from the back to the front side of the base 120, and is further passed through the elliptical attachment hole 64*a* of the rotation damper 60 by way of the window 138 of the arm 130, with the tip end of the winding end portion 42 being engaged with the attachment hole 64*a* of the rotation damper 60.

When the torsion spring 40 has been thus attached, the arm 130 is biased clockwise (as seen in FIG. 12) around the protruding axle 131 thereof.

The maximum rotation angle of the arm 130 is restricted by one winding end portion 41 of the torsion spring 40 abutting dead-end surfaces on either side of the arc-like cutout 127 of the base 120. That is, the maximum rotation angle of the arm 130 is restricted in one rotating direction by one winding end portion 41 of the torsion spring 40 when it abuts against the substantially vertical dead-end surface of the arc-like cutout 127 of the base 120, as indicated by the broken line of FIG. 12, where its resilient force is received. The maximum rotation angle in the reverse rotating direction of the arm 130, in contrast, is restricted, as indicated by the solid line of FIG. 12, by one winding end portion 41 of the torsion spring 40 when it abuts against the substantially horizontal dead-end surface of the arc-like cutout 127 of the base 120.

When it has been assembled, the reciprocating device 110 is fastened to the housing associated with the movable cover (not shown) by using the attachment members 122 and 123 of the base 120 thereof, and the connecting member 133 of the arm 130 is connected to the movable cover. When the reciprocating device 110 has been attached to the movable cover (not shown), the movable cover can be opened and closes on the protruding axle 131 of the arm 130 and is constantly biased in the opening direction by the resilient restoring force of the torsion spring 40.

Since it is formed symmetrically with respect to the line L—L intersecting the protruding axle 131 of the arm 130, the base 120 of this embodiment can be attached to either side of the movable cover.

That is, by turning the base 120 the other way round and attaching it to the housing (not shown) of the movable cover, with the attachment member 123 (FIG. 14) facing downwards, it is possible to attach two bases 120 symmetrically to the right and left sides of the movable cover. In that case, it is necessary to prepare different symmetrical arms 130 because of the directivity of the same. However, it is possible to use common parts for the bases 120 of the symmetrically arranged devices.

the reciprocating device 110 of this embodiment can be used as a counterpart of the reciprocating device 10 of the first embodiment. For example, the reciprocating device 10 of the first embodiment may be attached to one end of a movable cover (not shown), and the reciprocating device 110 of the second embodiment to the other end of the same. Of course, it is possible for the reciprocating device 110 of this embodiment to be used alone or to be attached to both sides of the movable cover (not shown).

The above embodiments of the present invention have been described only by way of example, and should not be construed restrictively. The scope of the present invention is defined by the appended claims, and all the variations embraced by these claims are embraced by the present invention.

What is claimed is:

1. A reciprocating device for a movable member comprising: a stationary member, a movable member held by said stationary member in such a manner as to be able to reciprocate, biasing means provided between said movable member and said stationary member and adapted to bias said movable member in at least one of reciprocating directions of said movable member, and a lock device for stopping said movable member in the course of reciprocation, said lock device including: a cam groove formed on either said stationary member or said movable member and extending around a heart-shaped island; a lock pin having a base end section rotatably supported by either said stationary member or said movable member on which said cam groove is not formed and a tip end section bent toward a bottom of said cam groove; and pressing means for pressing said tip end section of said lock pin toward the bottom of said cam groove, said cam groove including: an introduction path extending toward a pointed tapered section of said heart-shaped island; a forward path extending forwards along one side of said heart-shaped island while becoming gradually shallower than said introduction path; a dead-end turn-back section which is one step deeper than a shallowest end of said forward path; a stop section which is adjacent to and still one step deeper than said turn-back section and which extends along a pit section of said heart-shaped island; an escape section which is adjacent to and still one step deeper than said stop section and which extends toward the other side of said heart-shaped island up to a dead end; and a return path which extends along the other side of said heart-shaped island while becoming gradually shallower than said escape section so as to communicate with said introduction path and whose shallowest end is one step higher than a bottom of said introduction path, said pit section of said heart-shaped island of said lock device being equipped with a tapered surface which is inclined toward a bottom of said stop section of said cam groove, and said tip end section of said lock pin being bent at an angle corresponding to the inclination of said tapered surface of said pit section of said heart-shaped island.

2. A reciprocating device for a movable member according to claim 1 comprising: a base serving as said stationary member; a rack serving as said movable member and adapted to rotate in the normal and reverse directions; a torsion spring provided between said rack and said base and serving as said biasing means for biasing said rack counterclockwise ; the lock device for stopping said rack in the course of rotation against a torsional resilient restoring force of said torsion spring; and a rotation damper which is secured to said base and equipped with a gear in mesh with said rack and which serves as braking means.

3. A reciprocating device for a movable member according to claim 1, wherein said lock device includes: the cam groove formed on said movable member in such a manner as to extend around said heart-shaped island; the lock pin having the base end section rotatably supported by said stationary member and the tip end section bent toward the bottom of said cam groove, and a pressing spring serving as said pressing means for pressing the tip end section of said lock pin toward the bottom of said cam groove.

4. A reciprocating device for a movable member according to claim 1, wherein said stationary member includes: an axle hole for rotatably supporting said rack serving as said movable member; a boss section which is adjacent to said axle hole and protrudes from a back surface of said stationary member and through which a central ring section of said torsion spring passes; a fitting recess which is indented with respect to the surface of said stationary member and into which said rotation damper is fitted; and an attachment frame having a slit-like bearing section for bearing said rock pin and allowing the attachment of said pressing spring, said stationary member being formed of a synthetic resin having appropriate elasticity and rigidity, as one integral unit.

5. A reciprocating device for a movable member according to claim 1, wherein said movable member includes: a sector-like rack body; a protruding axle protruding backwards from a position corresponding to the center of the sector; and a bar-like connecting member positioned on the opposite side of said rack body with respect to said protruding axle and extending obliquely upwards to be connected with a movable cover, said movable member being formed of a synthetic resin having high rigidity, as one integral unit.

6. A reciprocating device for a movable member according to claim 2, wherein said rotation damper includes an oil damper which has a housing filled with an oil having high viscous resistance and which is adapted to exert, by virtue of the viscous resistance of said oil, a braking force on a torque of an input shaft extending through said housing.

7. A reciprocating device for a movable member comprising: a base serving as a stationary member and having a protruding axle; an arm serving as a movable member and rotatably supported by the protruding axle of said base and adapted to rotate in normal and reverse directions; a torsion spring serving as biasing means provided between the base and the arm to bias the arm in one of rotating directions around the axle thereof; and a rotation damper for damping a resilient torsional return force of said torsion spring, said base having an arc-like rack formed around the axle of said movable member, symmetrically with respect to a line intersecting the axle of said movable member, and said rotation damper being fastened to said arm and having a gear meshed with the rack of said base.

8. A reciprocating device for a movable member comprising: a stationary member including a sector-shaped base body and a pair of attachment members protruding from linear lower and side edges of said body, and formed of a synthetic resin as one integral unit; a movable member supported by said stationary member in such a manner as to be rotatable on an axis; biasing means provided between said movable member and said stationary member and for biasing said movable member in one of rotating directions around an axle thereof; and a rotation damper for damping a torque due to said biasing means, and being fastened to said movable member and having a gear meshed with said rack of said stationary member, said stationary member being equipped with an arc-like rack formed around said axle of said movable member, symmetrically with respect to a line intersecting said axle of said movable member.

9. A reciprocating device for a movable member according to claim 7, wherein said base includes a sector-shaped base body, an axle hole rotatably supporting a protruding axle of said arm and formed at a position of said base body substantially corresponding to the center of the sector; an arc-like rib formed around said axle hole and protruding from a surface of said base body; a rack formed on an outer peripheral surface of said arc-like rib and in mesh with the gear of said rotation damper; an arc-like rib cutout formed along an inner peripheral surface of said arc-like rib; and a boss section which is positioned between said arc-like cutout and said axle hole and on a symmetry line dividing said base body into two and intersecting said axle hole and through which a central ring section of said torsion spring passes.

10. A reciprocating device for a movable member according to claim 8, wherein said attachment members are formed symmetrically with respect to a symmetry line intersecting said axle hole of said base body.

11. A reciprocating device for a movable member according to claim 7, wherein said arm includes an arm body which has protruding axle at a one end portion and a connecting member which is positioned on the opposite side of said arm body with respect to said protruding axle and extends obliquely upwards to be connected with a movable cover, said arm being formed of a synthetic resin as one integral unit.

12. A reciprocating device for a movable member according to claim 11, wherein said protruding axle protrudes from a back surface of said arm body.

13. A reciprocating device for a movable member according to claim 12, wherein said arm body includes a fitting recess which is indented with respect to a back surface thereof and into which said rotation damper is fitted, and wherein said fitting recess includes a central indentation into which a round housing of said rotation damper is fitted and a pair of side indentations which are connected to right and left sides of said central indentation and into which a pair of attachment members protruding in opposite directions from said housing are respectively fitted.

* * * * *